US007115081B2

(12) United States Patent
Stearns

(10) Patent No.: US 7,115,081 B2
(45) Date of Patent: Oct. 3, 2006

(54) EXERCISE METHODS AND APPARATUS WITH TOTAL BODY SUPPORT

(76) Inventor: Kenneth W. Stearns, P.O. Box 55912, Houston, TX (US) 77255

( * ) Notice: Subject to any disclaimer, the term of this patent is extended or adjusted under 35 U.S.C. 154(b) by 0 days.

(21) Appl. No.: 10/863,051

(22) Filed: Jun. 7, 2004

(65) Prior Publication Data

US 2005/0272581 A1 Dec. 8, 2005

(51) Int. Cl.
*A63B 26/00* (2006.01)
*A63B 71/00* (2006.01)

(52) U.S. Cl. ..... 482/140; 482/907; 482/91; 21/687

(58) Field of Classification Search ..... 482/140, 482/148, 142, 70–72, 91, 907; D21/673–674, D21/687–688, 690, 686
See application file for complete search history.

(56) References Cited

U.S. PATENT DOCUMENTS 5,256,126 A * 10/1993 Grotstein ..... 482/142
5,330,404 A * 7/1994 Lopeteguy et al. ..... 482/91
5,411,458 A * 5/1995 Giust ..... 482/101
5,445,583 A * 8/1995 Habing ..... 482/52
5,669,865 A * 9/1997 Gordon ..... 482/142
6,113,524 A * 9/2000 Huang ..... 482/142
6,152,865 A * 11/2000 Beauvoir ..... 482/140
6,152,866 A * 11/2000 Kuo ..... 482/142
6,533,710 B1 * 3/2003 Lin et al. ..... 482/123
6,605,024 B1 * 8/2003 Stearns ..... 482/142
6,676,577 B1 * 1/2004 Stearns ..... 482/142
6,689,027 B1 * 2/2004 Gardikis, Jr. ..... 482/142
6,743,158 B1 * 6/2004 Giannelli et al. ..... 482/96
6,752,748 B1 * 6/2004 Scotti ..... 482/140
6,966,872 B1 * 11/2005 Eschenbach ..... 482/142
2002/0037793 A1 * 3/2002 Eschenbach ..... 482/140
2003/0022771 A1 * 1/2003 Stearns ..... 482/142
2003/0022772 A1 * 1/2003 Stearns ..... 482/142
2003/0158018 A1 * 8/2003 Giannelli et al. ..... 482/142
2004/0067829 A1 * 4/2004 Eschenbach ..... 482/140

* cited by examiner

*Primary Examiner*—Lori Amerson

(57) ABSTRACT

An exercise device includes a frame, a foot support mounted on the frame, and a body supporting linkage mounted on the frame. The linkage includes a seat, a lower back support, and an upper back and head support. Also, a handlebar is preferably mounted on the upper back and head support. The linkage is movably mounted on the frame in a manner that comfortably supports a person during both a leg press exercise and an abdominal crunch exercise. A resistance device is interconnected between the linkage and the frame to provide resistance to each type of exercise.

18 Claims, 5 Drawing Sheets

EXERCISE METHODS AND APPARATUS WITH TOTAL BODY SUPPORT

FIELD OF THE INVENTION

The present invention relates to exercise methods and apparatus, and in particular, to exercise devices that dynamically support a person's body during exercise.

BACKGROUND OF THE INVENTION

Various exercise devices have been developed to exercise various muscles of the human body. Examples of such devices are disclosed in U.S. Pat. Nos. 6,740,015, 6,676,577, and 6,491,608 to Stearns. Despite these advances in the art, room for continued improvement and innovation remains.

SUMMARY OF THE INVENTION

The present invention may be described in terms of an exercise device having a frame, a foot support mounted on the frame, and a body supporting linkage mounted on the frame. The body supporting linkage includes three discrete body props that are movably interconnected in serial fashion to comfortably support a user during performance of a leg press exercise and/or an abdominal crunch exercise. Many of the features and advantages of the present invention will become apparent to those skilled in the art from the more detailed description that follows.

BRIEF DESCRIPTION OF THE FIGURE OF THE DRAWING

With reference to the Figures of the Drawing, wherein like numerals designate like parts and assemblies throughout the several views, FIG. 1 is a perspective view of an exercise device constructed according to the principles of the present invention;

DETAILED DESCRIPTION OF A PREFERRED EMBODIMENT

Figure 1:
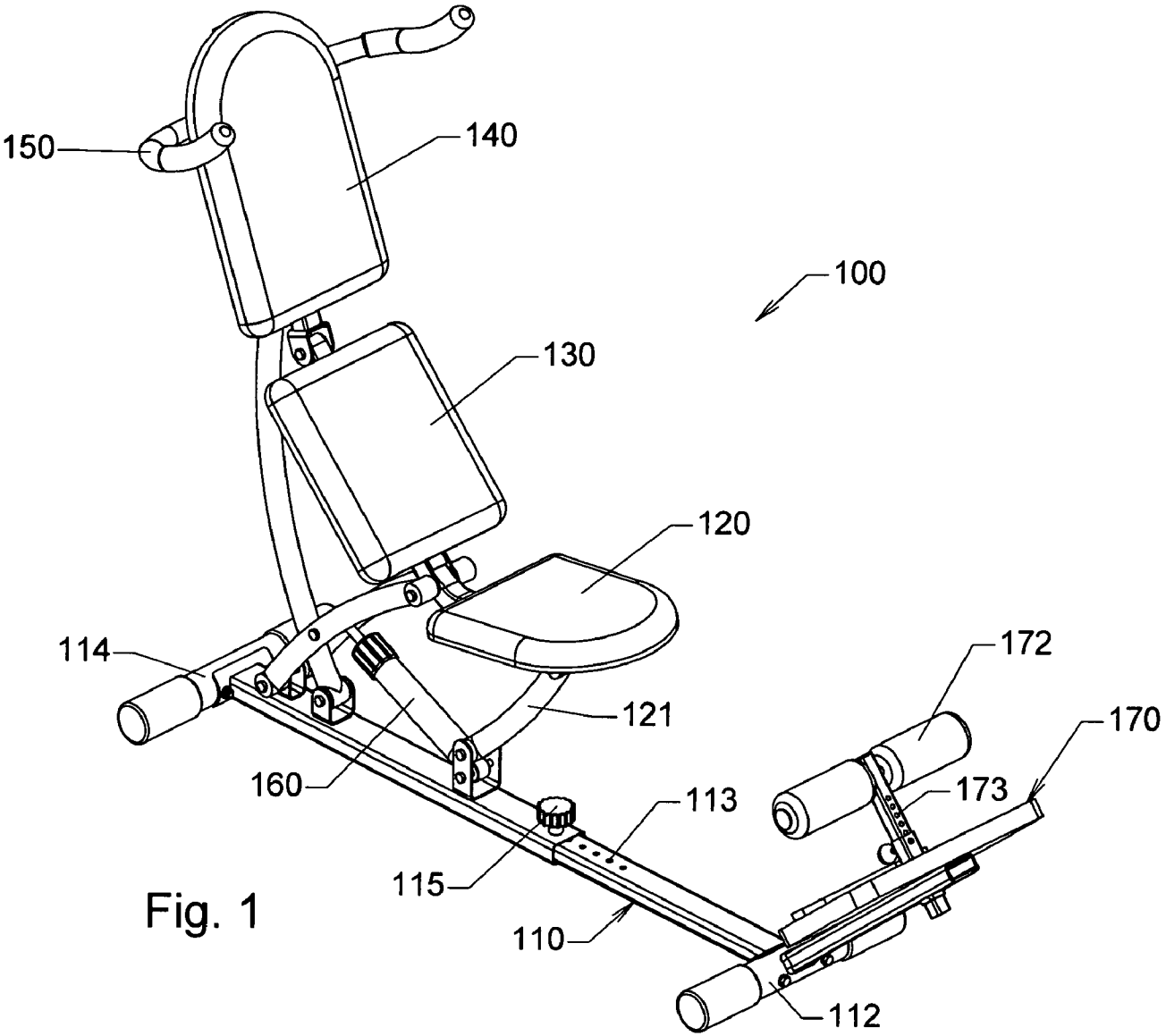
Figure 2:
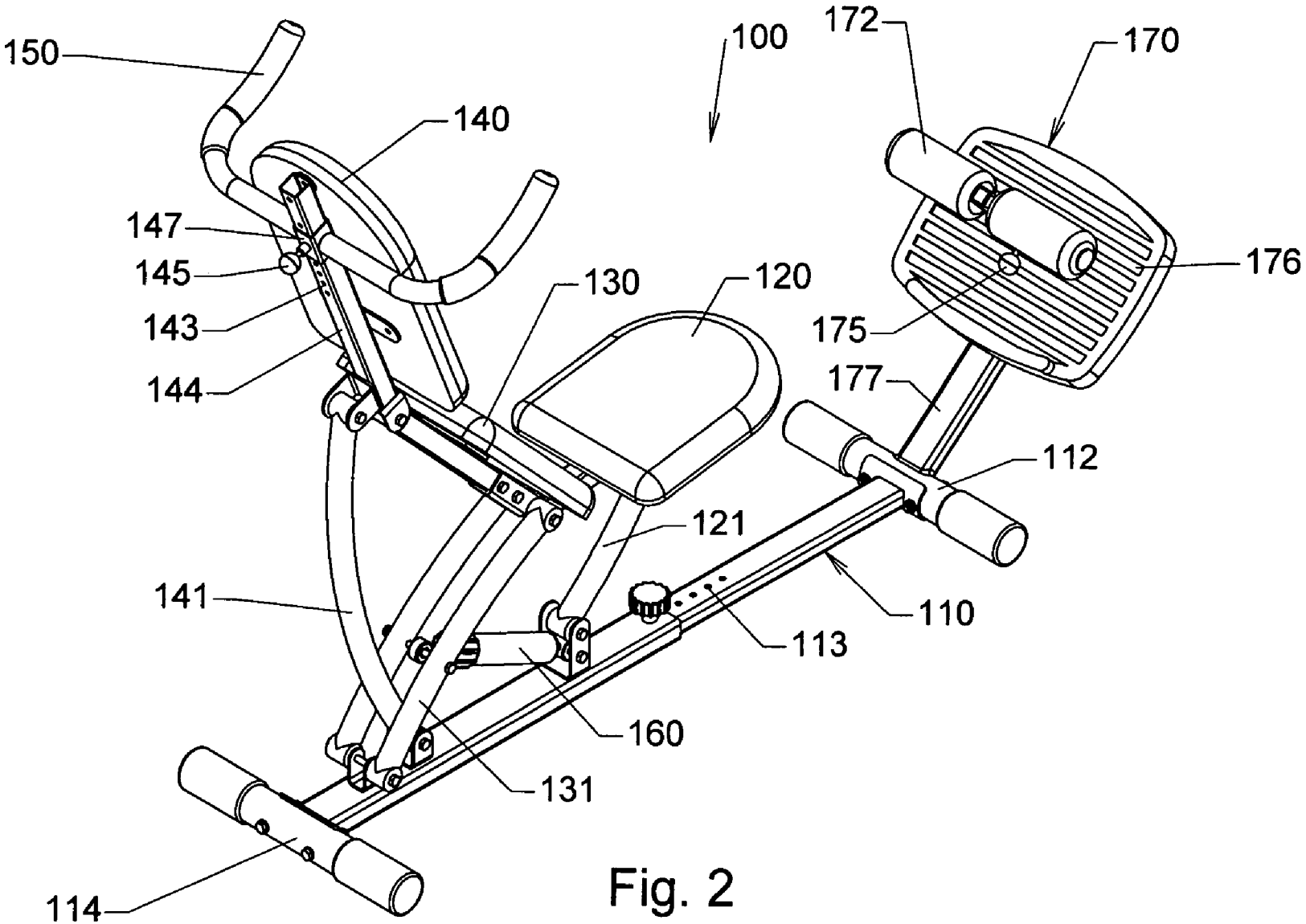
FIG. 2 is a different perspective view of the exercise device of FIG. 1.
Figure 3:
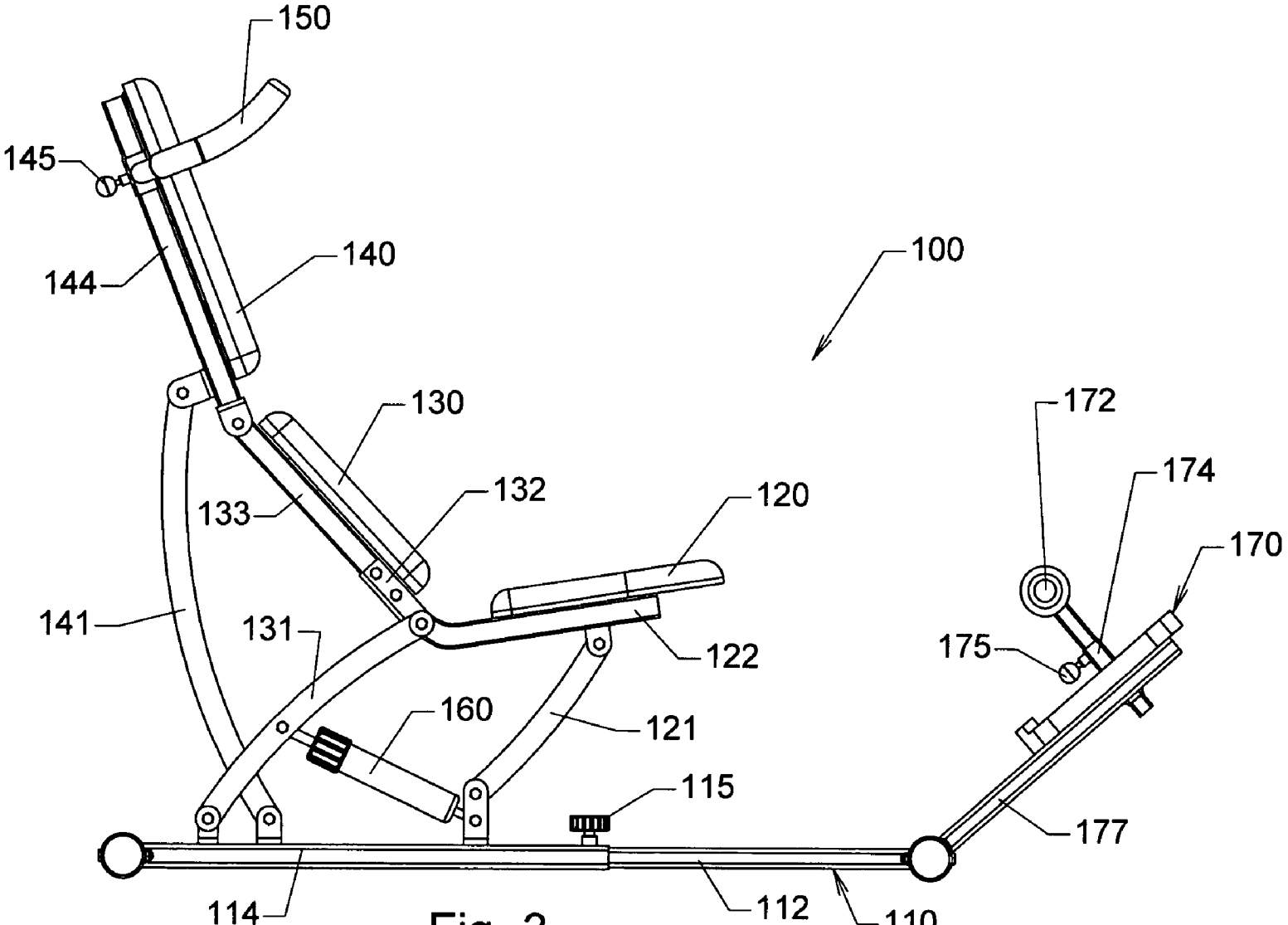
FIG. 3 is a side view of the exercise device of FIG. 1.

An exercise apparatus constructed according to the principles of the present invention is designated as 100 in FIGS. 1–3. The apparatus 100 may be described generally in terms of a frame 110, a foot support 170 mounted on the frame 110, and a body supporting linkage mounted on the frame 110.

The frame 110 is an I-shaped member that is designed to occupy a stationary position on an underlying floor surface. The frame 110 includes forward and rearward T-shaped members 112 and 114 that are selectively interconnected by a fastener 115 (of a type known in the art). More specifically, a rearward end of the forward member 112 telescopes into a forward end of the rearward member 114, and the fastener 115 is inserted through a hole in the rearward member 114 and any of several holes 113 in the forward member 112. This arrangement allows the overall length of the device 100 to be adjusted to accommodate persons of various heights.

The foot support 170 is rigidly mounted on an opposite, forward end of the forward member 112. In particular, a bar 177 is secured to the forward end of the forward member 112, and extends upward and forward to support a platform 176 that is sized and configured to support a person's feet in side-by-side formation. As shown in FIG. 3, a tube 174 is also rigidly secured to the bar 177, and extends perpendicular to the platform 176. A T-shaped member 172 includes a slightly smaller bar that telescopes into the tube 174. A fastener 175 (of a type known in the art) is inserted through a hole in the tube 174 and any of several holes 173 in the smaller bar. Cylindrical pads are mounted on opposite ends of the T-shaped member 172 to overlie a person's feet on the foot platform 176. The holes 173 and fastener 175 facilitate adjustment of a distance defined between the foot platform 176 and the overlying pads. Alternative arrangements, including a single looped strap or a pair of looped straps, may be substituted for the T-shaped member 172 without departing from the scope of the present invention.

The linkage assembly includes three discrete body supporting props 120, 130, and 140, each of which preferably includes a pad that is reinforced by a rigid panel. The lower prop 120 is sized and configured to engage a person's buttocks, and may alternatively be described as a seat. The upper prop 140 is sized and configured to engage a person's head and upper back, and may alternatively be described as a head rest. The intermediate prop 130 is sized and configured to engage a person's lower back, and it is pivotally interconnected between the other two props 120 and 140.

The intermediate prop 130 is rigidly mounted on a link 133, which is preferably a steel tube. An upper end of the link 133 is pivotally connected to a trunnion (on bar 144), and a lower end of the link 133 is rigidly connected to a bracket 132 (by bolts or other suitable means). The bracket 132 is rigidly secured to the upper end of a link 131 (by welding or other suitable means), and an opposite, lower end of the link 131 is pivotally connected to the frame 110. As a result of this arrangement, the links 131 and 133 are constrained to pivot about the same axis disposed near the rear end of the frame 110.

The lower prop 120 is rigidly mounted on a link 122, which is preferably a steel tube. A rearward end of the link 122 is pivotally connected to the rigidly interconnected links 131 and 133, and the resulting pivot axis is constrained to pivot about the same axis as the links 131 and 133. A link 121 has an upper end pivotally connected to an intermediate portion of the link 122 (at a location beneath the seat 120), and an opposite, lower end pivotally connected to the frame 110 (at a relatively forward location on the rearward frame member 114).

The upper prop 140 is rigidly mounted on a link 144, which is preferably a steel tube. As noted above, the lower end of the link 144 is pivotally connected to the upper end of the link 133. The lower end of the link 144 is also pivotally connected to the upper end of a link 141, though at a discrete, less distal location. An opposite, lower end of the link 141 is pivotally connected to the frame 110 at a location between the other two frame-based pivot axes described above. In other words, the links 141 and 131 cross one another when viewed from either side of the apparatus 100. Recognizing that the links 121, 131, and 141 may be described as rockers because they rock or pivot back and forth relative to the frame 110, the link 141 may also be described as pivoting about a rocker axis disposed between the respective rocker axes for the links 121 and 131.

As shown in FIG. 2, reinforcing flanges may be secured beneath the prop 140 (as well as the props 130 and 120) to ensure structural integrity during use of the apparatus 100. Also, a generally U-shaped handlebar 150 is secured to the link 144 in a manner that provides left and right hand grips that extend forward from respective sides of the head rest 140. More specifically, the handlebar 150 includes an intermediate sleeve 147 that is slidably mounted on the link 144, and a fastener 145 (of a type known in the art) is inserted through a hole in the sleeve 147 and any of several holes 143 in the link 144 to secure the handlebar 150 in place. This arrangement allows the handlebar 150 to be adjusted along the head rest 140 to accommodate persons of different sizes.

A resistance device or resistance means 160 is pivotally interconnected between the frame 110 and an intermediate portion of the link 131. The resistance device 160 is preferably a combination shock absorber and spring, an example of which is disclosed in U.S. Pat. No. 5,072,928 to Stearns, which is incorporated herein by reference. Other resistance devices may be used without departing from the scope of the present invention. For example, elastic bands may be used alone or in combination with a fluid cylinder. Moreover, persons skilled in the art will recognize that the resistance means may be interconnected between different components of the apparatus 100, including two different links that move relative to one another.

Figure 5:
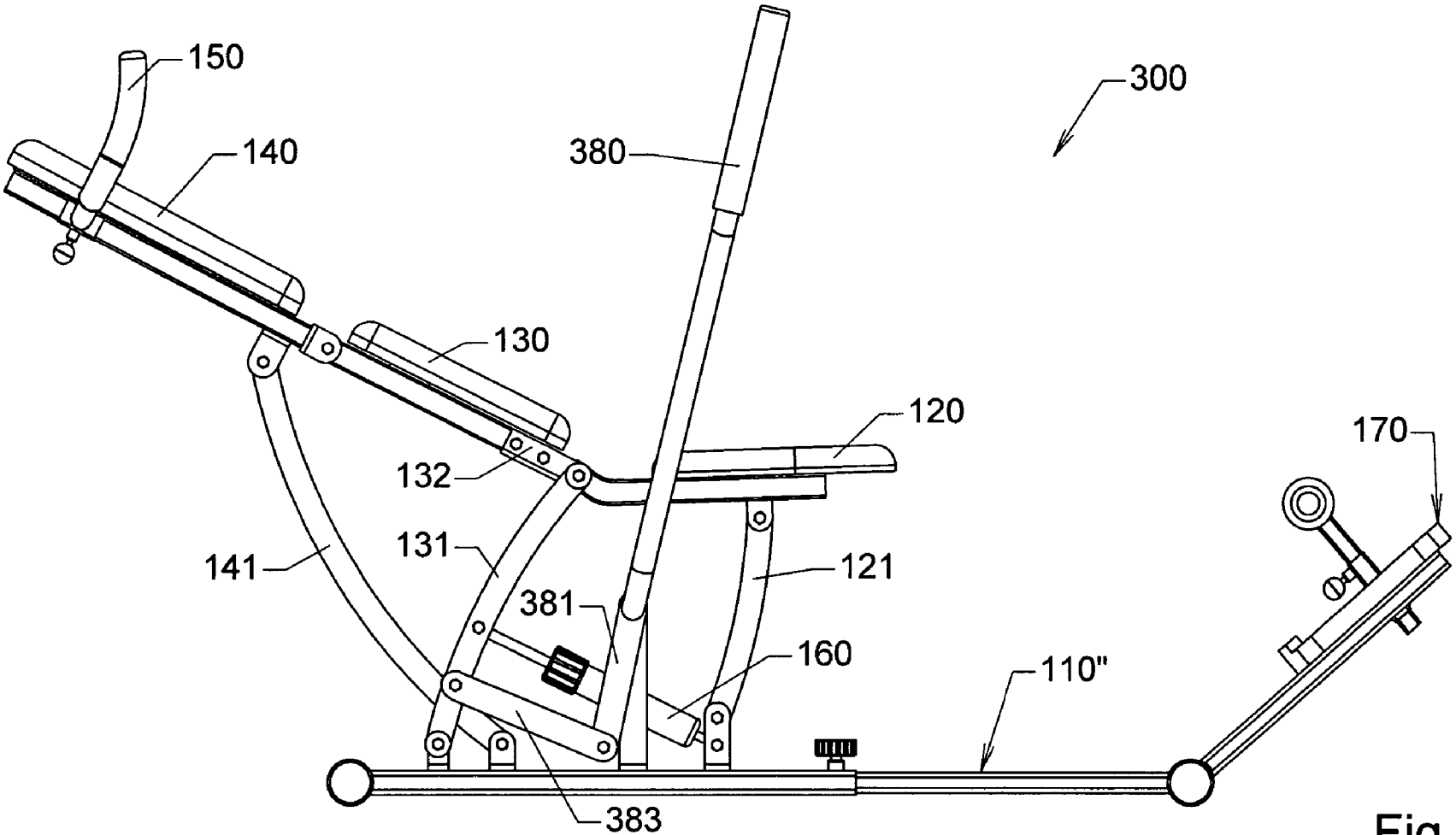
FIG. 5 is a side view of a third exercise device constructed according to the principles of the present invention.

To use the apparatus, a person sits on the seat 120 and leans back against the other body props 130 and 140. The person also grabs the ends of the handlebar 150, and places his feet on the foot platform 176 and behind the respective, opposite ends of the T-shaped member 172. From the position-shown in FIG. 3, the person uses his legs to push the linkage assembly rearward (away from the foot platform 176). This action causes the body props 120, 130 and 140 to recline or move closer to horizontal, as shown in FIG. 5 with reference to an alternative embodiment 300. From this reclined position, the person contracts his abdominal muscles (while pulling against the handlebar 150 and or the T-shaped member 172) to return the body props 120, 130, and 140 to the position shown in FIG. 3.

The spring portion of the resistance device 160 biases the linkage assembly toward the position shown in FIG. 3, and the damper portion of the resistance device 160 resists movement of the linkage assembly in either direction. If elastic bands are used as an alternative resistance means, they must be "flipped" to resist movement in alternative directions. In other words, they would be arranged as shown in FIG. 3 to resist the leg press motion, and they would alternatively be connected to the frame 110 proximate the rearward end of the rearward frame member 114 to resist the abdominal crunch motion. For manual adjustment, separate pegs would be provided at each frame location to facilitate adjustment between the two positions. For automatic adjustment, a lever assembly may be used to relocate the base end of the elastic band(s). The magnitude of elastic band resistance may be adjusted by changing the type and/or number of bands, and/or the mechanical advantage of the band(s) relative to the movement of the linkage.

The configuration and arrangement of the body props 120, 130, and 140 is such that the user is comfortably supported throughout the leg press motion and throughout the abdominal crunch motion. Also, each exercise motion may be performed through a relatively lengthy and desirable range of motion.

Figure 4:
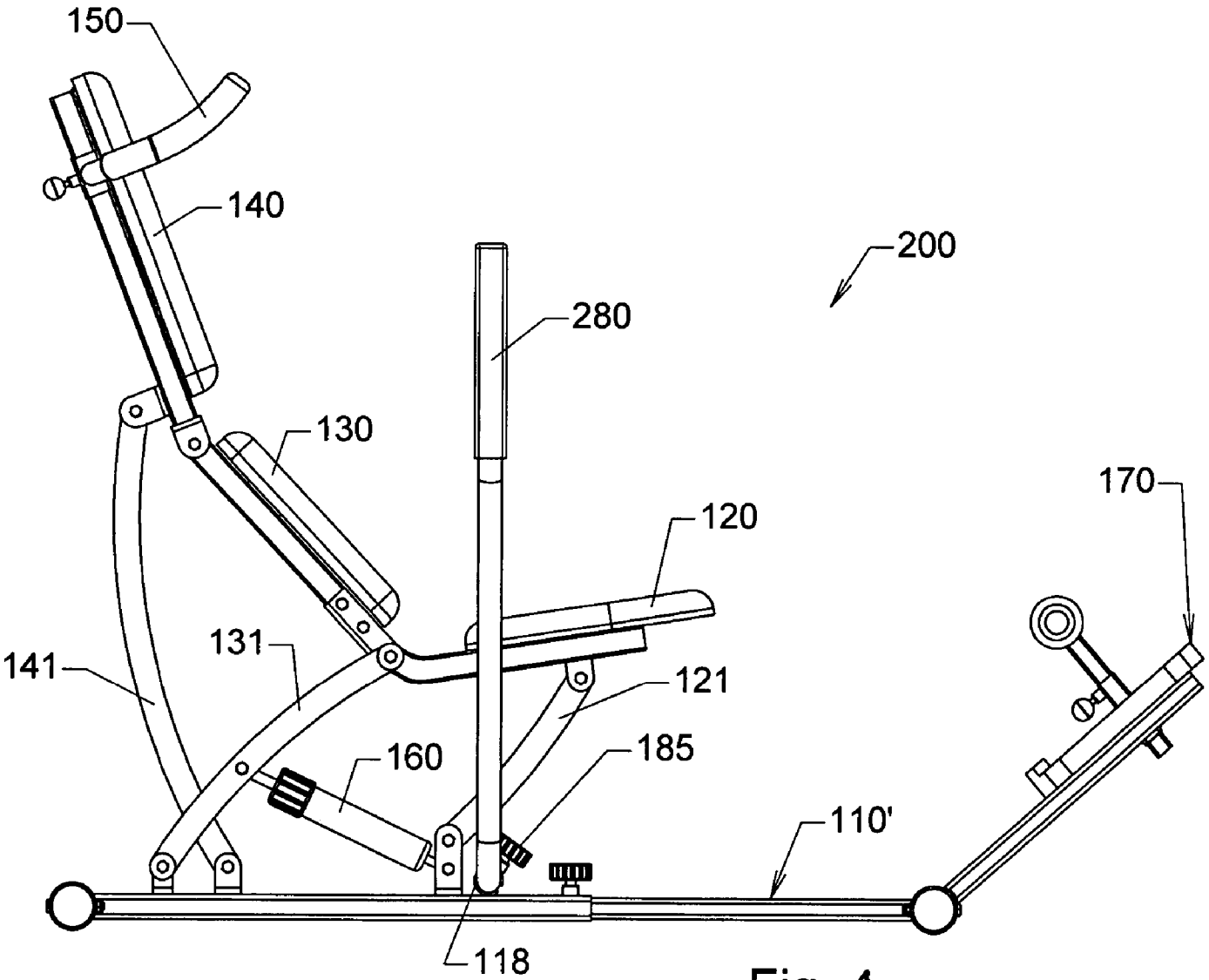
FIG. 4 is a side view of a second exercise device constructed according to the principles of the present invention.

FIG. 4 shows an alternative embodiment 200 that is similar in many respects to the first embodiment 100, as suggested by the common reference numerals. In fact, the only difference between the two embodiments 100 and 200 is the addition of a fixed handlebar 280 on the apparatus 200.

The handlebar 280 is preferably a U-shaped member comprising a central steel tube, and opposite, left and right L-shaped steel tubes. The upper end of each L-shaped tube is provided with a hand grip that is sized and configured for grasping. The central tube nests inside the opposite, lower ends of the L-shaped tubes, and is secured thereto. The assembly is disposed inside a bracket 118 on the frame 110', and a fastener 185 (of a type known in the art) secures the handlebar 280 in place on the frame 110. The handlebar 280 provides alternative handholds that allow a person to perform chest press exercises (by pushing against the handlebar 280), and/or row exercises (by pulling on the handlebar 280).

FIG. 5 shows another alternative embodiment 300 that is similar in many respects to the preceding embodiment 200, as suggested by the common reference numerals. In fact, the only difference between the two embodiments 200 and 300 is that a moving handlebar 380 has been substituted for the fixed handlebar 280.

The handlebar 380 is preferably a U-shaped member comprising a central steel tube, and opposite, left and right L-shaped steel tubes. The upper end of each L-shaped tube is provided with a hand grip that is sized and configured for grasping. The central tube nests inside the opposite, lower ends of the L-shaped tubes, and is secured thereto. The assembly is rotatably mounted on the frame 110", and rigidly secured to a link 381 (which preferably includes parallel bars on respective sides of the apparatus 300). Another link 383 (which similarly preferably includes parallel bars on respective sides of the apparatus 300) is pivotally interconnected between a lower end of the link 381 and an intermediate portion of the link 131.

The link 383 constrains the handlebar 380 and the link 131 to pivot in opposite directions relative to the frame 110". As on the previous embodiment 200, a person can perform chest press exercise by pushing against the handlebar 380 (causing the body supporting linkage to move toward the positions shown in FIG. 5), and/or row exercise by pulling on the handlebar 380 (causing the body supporting linkage to move toward the position shown in FIG. 3).

The present invention has been described with reference to specific embodiments and particular applications. However, this disclosure will enable persons skilled in the art to recognize additional embodiments and/or applications that nonetheless incorporate the essence of the present invention. Moreover, persons skilled in the art will recognize that the present invention may be described in terms of various methods with reference to the foregoing embodiments. With the foregoing in mind, the scope of the present invention is to be limited only to the extent of the following claims.

What is claimed is:

1. An exercise apparatus, comprising:

a frame;

a foot support mounted on the frame;

a body supporting linkage mounted on the frame, the linkage including an intermediate prop pivotally mounted on the frame for pivoting about a pivot axis on the frame, an upper prop pivotally connected directly to an upper end of the intermediate prop, a lower prop pivotally connected directly to a lower end of the intermediate prop, a first rocker link pivotally connected directly to the lower prop and pivotally connected directly to the frame, and a second rocker link pivotally connected directly to the upper prop and pivotally connected directly to the frame; and a resistance device operatively interconnected between the linkage and the frame.

2. The exercise apparatus of claim 1, wherein the upper prop is configured and arranged to engage a person's head, and the intermediate prop is configured and arranged to engage a person's lower back, and the lower prop is configured and arranged to engage a person's buttocks.

3. The exercise apparatus of claim 2, further comprising a handlebar mounted on the upper prop.

4. The exercise apparatus of claim 1, wherein the foot support includes a rigid platform.

5. The exercise apparatus of claim 4, wherein the foot support further includes an overlapping structure that cooperates with the platform to retain a person's feet therebetween in a manner that allows a person to push against the platform and pull against the overlapping structure.

6. The exercise apparatus of claim 1, wherein the frame is adjustable in length between the foot support and the body supporting linkage.

7. The exercise apparatus of claim 1, wherein the second rocker link pivots about a rocker pivot axis at a location on the frame between the pivot axis and the foot support.

8. The exercise apparatus of claim 1, wherein the first rocker link pivots about a rocker pivot axis at a location on the frame between the pivot axis and the foot support.

9. The exercise apparatus of claim 8, wherein the second rocker link pivots about a discrete pivot axis at a location on the frame between the pivot axis and the rocker pivot axis.

10. The exercise apparatus of claim 9, wherein the upper prop is configured and arranged to engage a person's head and upper back, and the intermediate prop is configured and arranged to engage a person's lower back, and the lower prop is configured and arranged to engage a person's buttocks.

11. The exercise apparatus of claim 10, further comprising a handlebar mounted on the upper prop.

12. The exercise apparatus of claim 1, wherein the resistance device includes a spring interconnected between the intermediate prop and a portion of the frame disposed forward of the pivot axis.

13. The exercise apparatus of claim 1, wherein the resistance device includes a damper that resists movement of the linkage in both forward and rearward directions relative to the foot support.

14. The exercise apparatus of claim 1, wherein the linkage is constrained to move relative to the frame between a first position, wherein each said prop cooperates to support a user in a seated position, and a second position, wherein each said prop cooperates to support a user in a supine position.

15. An exercise apparatus, comprising:

a frame;

a foot support mounted on the frame;

a body supporting linkage mounted on the frame, the linkage including (a) an intermediate prop pivotally mounted on the frame, thereby defining a first pivot axis; (b) an upper prop pivotally connected to an upper end of the intermediate prop, thereby defining a second pivot axis; (c) a lower prop pivotally connected to a lower end of the intermediate prop, thereby defining a third pivot axis; (d) a first rocker link pivotally interconnected between the lower prop and the frame, thereby defining a fourth pivot axis and a fifth pivot axis, respectively; and (e) a second rocker link pivotally interconnected between the upper prop and the frame, thereby defining a sixth pivot axis and a seventh pivot axis, respectively; and a resisting means for resisting movement of the linkage relative to the frame.

16. A method of facilitating exercise, comprising the steps of:

providing a frame;

mounting a foot support on the frame;

providing a body supporting linkage that includes a seat link, a head rest link, and an intermediate link pivotally connected directly to the seat link and pivotally connected directly to the head rest link;

movably mounting the body supporting linkage on the frame in such a manner that movement of any said link relative to the frame causes each said link to move relative to the frame; and interconnecting a resistance device between the body supporting linkage and the frame in a manner that resists movement of the body supporting linkage in both a first direction relative to the frame and an opposite, second direction relative to the frame.

17. The method of claim 16, wherein the movably mounting step involves pivotally mounting the intermediate link to the frame; pivotally interconnecting a first rocker link directly between the seat link and the frame; and pivotally interconnecting a second rocker link directly between the head rest link and the frame.

18. The exercise apparatus of claim 15, wherein the first rocker link is pivotally connected to the frame at a first distance from the foot support, and the second rocker link is pivotally connected to the frame at a second distance from the foot support, and the intermediate prop is pivotally connected to the frame at a third distance from the foot support, and the second distance is greater than the first distance, and the third distance is greater than the second distance.

* * * * *